US008484775B2

(12) United States Patent
Littlefield

(10) Patent No.: US 8,484,775 B2
(45) Date of Patent: Jul. 16, 2013

(54) INCLINE INFANT CRIB

(76) Inventor: Matthew S. Littlefield, Hampton, VA (US)

( * ) Notice: Subject to any disclaimer, the term of this patent is extended or adjusted under 35 U.S.C. 154(b) by 0 days.

(21) Appl. No.: 12/891,432

(22) Filed: Sep. 27, 2010

(65) Prior Publication Data

US 2013/0097775 A1 Apr. 25, 2013

Related U.S. Application Data

(60) Provisional application No. 61/245,921, filed on Sep. 25, 2009.

(51) Int. Cl.
*A47D 7/03* (2006.01)

(52) U.S. Cl.
USPC ..... 5/93.1; 5/11

(58) Field of Classification Search
USPC ..... 5/11, 93.1, 509.1, 610
See application file for complete search history.

(56) References Cited

U.S. PATENT DOCUMENTS 1,694,659 A * 12/1928 Kusterle ..... 5/11
2,481,965 A * 9/1949 Woller ..... 5/11
3,537,115 A * 11/1970 Gordin ..... 5/207
3,638,247 A * 2/1972 Kennedy ..... 5/11
4,934,007 A * 6/1990 Sweet ..... 5/610

* cited by examiner

*Primary Examiner* — Michael Trettel
(74) *Attorney, Agent, or Firm* — Duncan G. Byers; Byers Law Group

(57) ABSTRACT

A crib wherein one end of the bed portion of the crib is hinged and the other end of the bed portion of the crib includes handles which protrude through the bedposts of the crib. Holes in the bedpost correspond to holes in the handles so that, when the unhinged end of bed portion is lifted vertically, a pin may be used to secure the unhinged portion, providing a desired angle of elevation to the bed portion of the crib.

6 Claims, 2 Drawing Sheets

INCLINE INFANT CRIB

This invention claims the benefit of U.S. Provisional Patent Application No. 61/245,921 for Incline Infant Crib filed on Sep. 25, 2010.

FIELD OF THE INVENTION

This invention relates to infant cribs, and, in particular, relates to an improved adjustable incline infant crib design.

BACKGROUND OF THE INVENTION

With infants, treating pressure pains in the sinus cavities or congestion requires careful, delicate treatment. The adult caretaker's inability to verbally communicate with an infant along with the challenges of treating the underlying causes of the condition directly impede the caretakers' ability to render such treatment. It is generally accepted that infants (which for purposes of this discussion include children of about three years old and younger) who suffer with head congestion sleep more comfortably when their heads are slightly elevated from the traditional horizontal, flat sleeping position characteristic of that of the traditional baby crib.

An infant's exposure to some foreign particles may trigger allergies, a cold or flu, all of which may lead to the infant developing an upper respiratory infection. When this occurs, an infant's immune system which initially is weak and becomes stronger as the infant grows over time is attacked. Use of conventional medications in these situations, however, is not desirable since use of the medications may likely cause harmful side effects for the infants.

Allergies, which may be triggered by exposure to environmental substances such as pollens and/or chemical irritants, and infectious viruses or bacteria, may ultimately lead to sinusitis in infants. Sinusitis is defined to be the inflammation of the mucus membranes of one or more of the sinuses which are the air spaces located in the bone cavities that surround the nose, and is one of the most common respiratory ailments. When an infection causes inflammation and swelling of the mucus membranes in the nose, the swollen membranes block the sinus openings and prevent the mucus that is produced by the mucus membranes from draining. Once the mucus drainage becomes blocked, the area in which allergens, bacteria and/or viruses trapped in the sinuses can grow. Some of the most common symptoms of sinusitis include congestion, pressure pains and discomfort around the affected area, sore throat, headache, cough, and fever. Unfortunately, infants who develop these symptoms may experience choking, nausea, vomiting, and diarrhea.

While an infant who is suffering with a cold or flu is sleeping, mucus drains down his/her throat and into the stomach. If enough mucus accumulates in the stomach, it can cause the child to gag and eventually vomit. As such, the infant is in much discomfort due to the post nasal drip, coughing, nausea, vomiting, and sleeplessness. In addition to attending to the infant, the adult caretaker must also maintain sanitary conditions by bathing the infant as needed, changing crib sheets, disinfecting the crib, and the like.

As previously suggested, infants who suffer with head congestion sleep more comfortably when their heads are slightly elevated from the traditional horizontal, flat sleeping position characteristic of that of the traditional baby crib. In this regard, the prior art offers devices that may be used to insert directly under the crib mattress. This may not be desirable, however, as the tight fit of crib mattresses within the structure of the crib may make it difficult to place the device under the mattress, considering that the position of the device may shift during use, and that such use may create a safety hazard of gaps along the sides of the crib wherein the infant may become trapped. hi other instances, there exists prior art that seeks to achieve an elevated head position by way of means used to adjust the spring bottom of cribs. These systems and methods however do not provide adequate stability particularly in light of current safety standards for baby cribs.

Accordingly, there is a need to develop a means to adjust an infant crib in a safe, reliable, and effective manner. The present invention is designed to address these needs.

DESCRIPTION OF A PREFERRED EMBODIMENT

Figure 1:
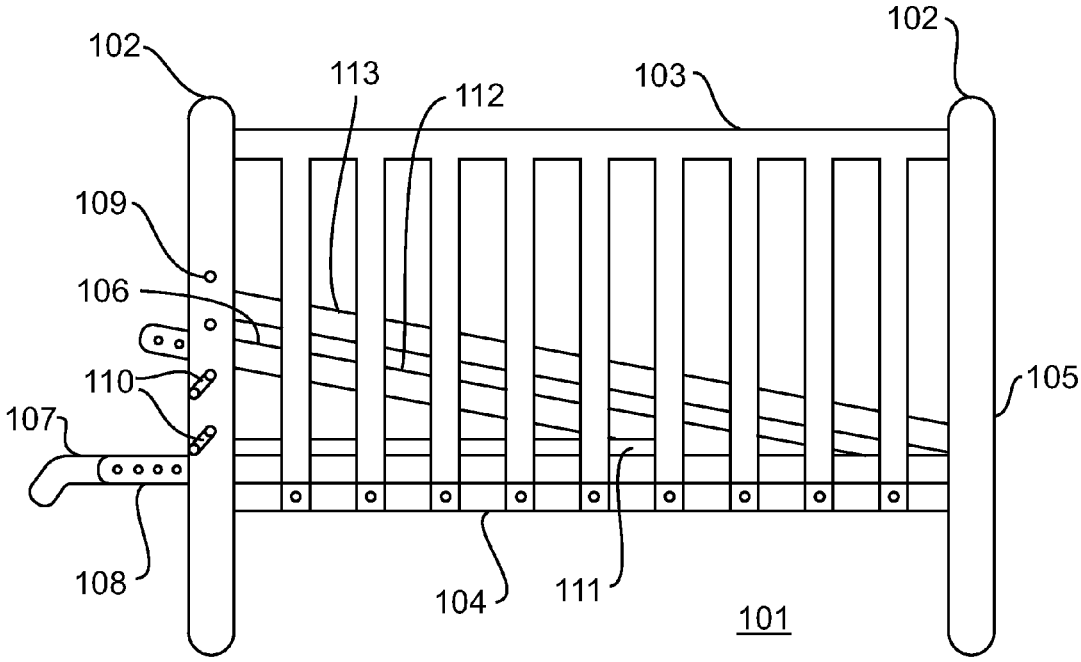
FIG. 1 is a side view of an embodiment of the present invention.

Referring now to FIG. 1, a side view of the present invention is shown. A crib 101 has a plurality of bedposts 102, side rails 103 and a bed portion 104. The bedposts 102 are connected by one or more end rails 401 (FIG. 4) that are positioned in the same plane as the bed portion 104. It will be understood that cribs 101 such as that contemplated herein are generally constructed with end portions that are then connected by longer side portions, creating a rectangular box structure. For the purposes of the invention herein, the crib 101 may be constructed in any feasible manner so long as the crib 101 incorporates the invention as disclosed herein.

The bed portion 104 as shown has a hinged end 105 and a lifting end 106. The bed portion 104 may be constructed of any well-known rigid or semi-rigid materials such as plastic, wood, and the like. The hinged end 105 of the bed portion 104 is hingedly attached to an end rail 401 utilizing hinges 201 (FIG. 2) that are well known in the art. The lifting end 106 of the bed portion 104 further comprises lifting handles 107, which are designed so that they can be easily grasped by a user, and may be curved or otherwise ergonomically designed. In a preferred embodiment, the present invention incorporates two or more lifting handles 107, located apart from each other and passing through handle slots 402 located in the bedposts 102 located at the lifting end 106 of the crib 101. The lifting handles 107 further comprise a plurality of handle holes 108 that pass through the lifting handles 107, and the handle holes 108 correspond in spacing and size to a plurality of bedpost holes 109 such that, if the lifting end 106 of the bed portion 104 is lifted vertically within the crib 101, at each bedpost hole 109, a pin 110 may be inserted into the bedpost hole 109 and thereby through a corresponding handle hole 108. With a pin 110 inserted through the bedpost hole 109 and the handle hole 108, the bed portion 104 will be retained at a desired height. The bed portion 104 is shown in a horizontal position 111, a first elevated position 112, and a second elevated position 113.

Figure 2:
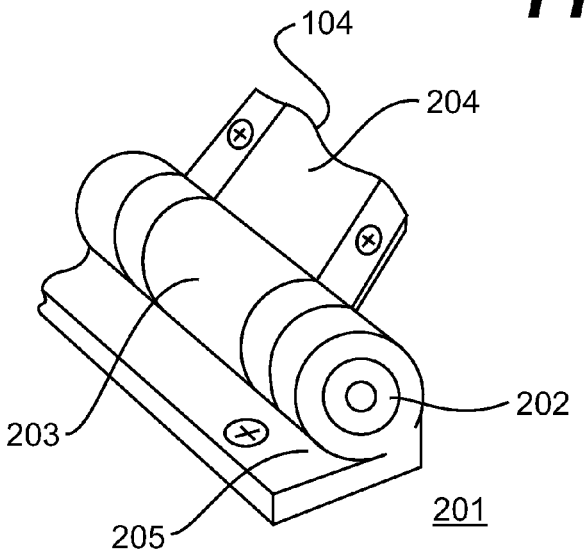
FIG. 2 is a detailed view of the pivot portion of an embodiment of the present invention.

Referring now to FIG. 2, a detail view of a hinge 201 utilized in an embodiment of the present invention is shown. While only a single hinge is shown for explanatory purposes, it will be understood that a plurality of hinges 201 may be utilized, with an optimum number being two or more hinges

201. The hinge 201 comprises a center portion 202 and an outer portion 203 which may be rotated about the center portion 202. The outer portion 203 further comprises a connecting portion 204 which affixedly attaches the hinge 201 to the bed portion 104. The hinge 201 further comprises a base portion 205, which is affixed to the end rail 401 located at the hinge end 105 of the bed portion 104.

Figure 3:
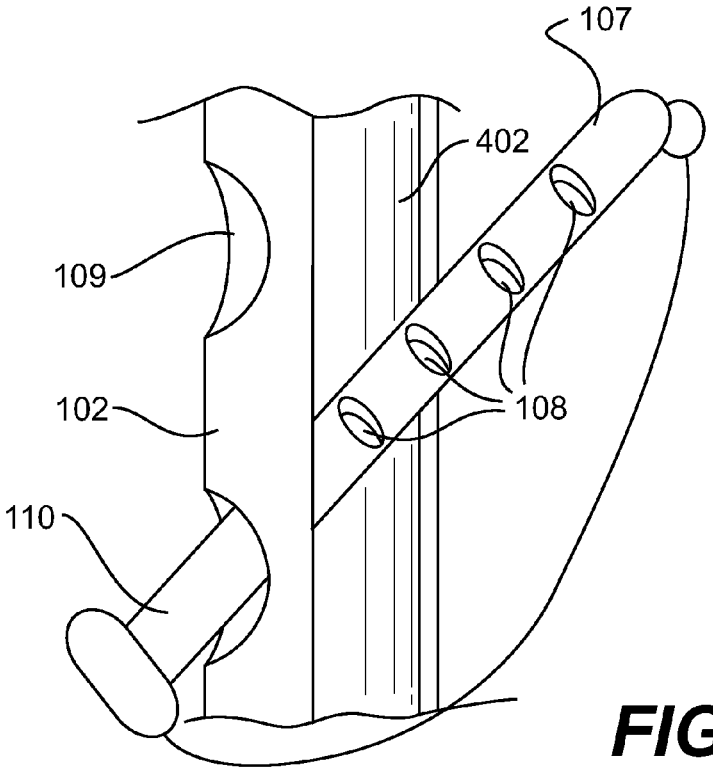
FIG. 3 is a detailed view of the handle portion of the present invention.

Referring now to FIG. 3, a closeup view of a bedpost 102 is shown with a handle slot 402, a handle 107 passing through the handle slot 402, with a handle hole 108 positioned next to a bedpost hole 109, and a pin 110 being positioned through the handle hole 108 and the bedpost hole 109 such that the handle 107 is kept at a desired height, providing a desired sleeping angle on the bed portion 104. The pin 110 further preferentially comprises restraining means 301 such that the pin 110 cannot be accidentally bumped out of or removed from the locking position.

Figure 4:
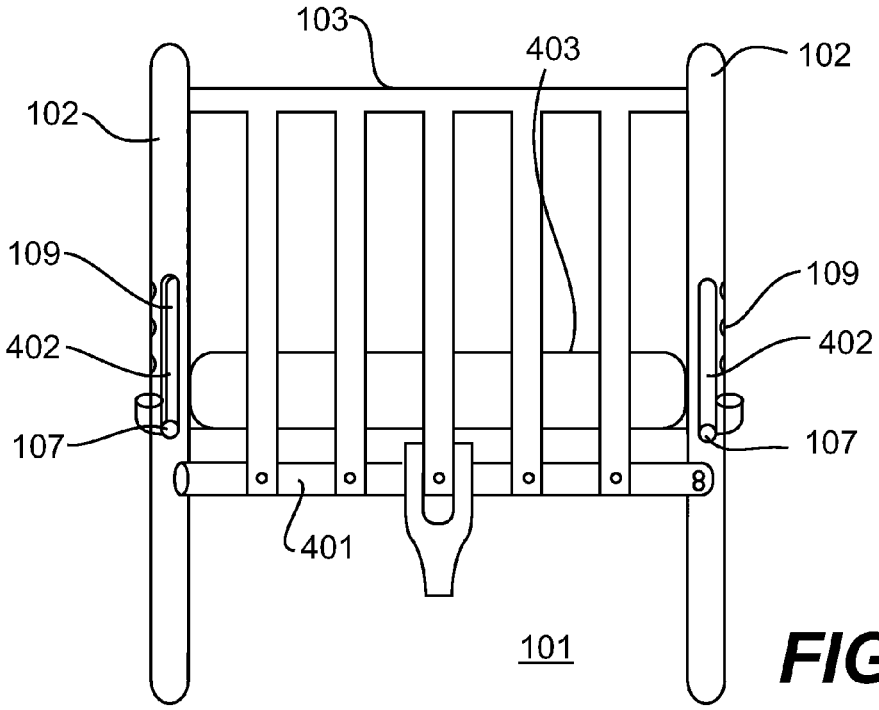
FIG. 4 is an end view of an embodiment of the present invention.

Referring now to FIG. 4, an end view of a crib 101 is shown. The bedposts 102 are connected with an end rail 401 and side rails 103. The handle portions 107 are shown end-on and are in the lowest position, with the bed portion 104 parallel to the ground upon which the crib 101 rests. The handle slots 402 and the bedpost holes 109 are also shown.

The invention herein has been described in detail, and in light of the FIGS. 1-4. It will be understood, however, that the description herein is not intended to be limiting, and variations in materials and configuration of the invention may be made without exceeding the scope of the invention.

I claim:

1. A crib comprising:

a plurality of bedposts, the bedposts connected by side rails, end rails and a bed portion;

the bed portion hingedly attached to an end rail at a hinged end by means of one or more hinges;

the bed portion having lifting means at a lifting end that is distal to the hinged end of the bed portion such that the lifting end of the bed portion may be elevated relative to the horizontal plane of the crib while the hinged end remains attached to the end rail at the hinged end of the crib;

the lifting end further comprises handles;

the said bedposts that are located at the lifting end further comprise slots, and the said handles extend through the said slots in the bedposts; and means for securing the lifting end of the bed portion in an elevated position.

2. The crib of claim 1 wherein the means for securing the lifting end of the bed portion comprises one or more pins inserted through corresponding holes in the said lifting end and the said bedposts.

3. The crib of claim 2 wherein the lifting end further comprises handles, and the said holes in the lifting end are contained within the said handles.

4. The crib of claim 3 wherein the said bedposts further comprise slots, and the said handles extend through slots in the said bedposts.

5. The crib of claim 4 wherein a pin is inserted through the said holes in the said handles and the said bedposts, securing the said lifting end of the said bed portion.

6. A crib comprising:

a plurality of bedposts, the bedposts connected by side rails, end rails and a bed portion;

the bed portion hingedly attached to an end rail at a hinged end by means of one or more hinges;

the bed portion having lifting means at a lifting end that is distal to the hinged end of the bed portion such that the lifting end of the bed portion may be elevated relative to the horizontal plane of the crib while the hinged end remains attached to the end rail at the hinged end of the crib;

the lifting means comprising handles, the handles further comprising holes;

the bedposts further comprising slots through which the said handle portions protrude;

the bedposts further comprising holes which correspond to the said holes located in the said handles; and means for securing the lifting end of the bed portion in an elevated position, the means for securing the lifting end comprising a pin inserted through the said holes located in the said handle portions and the said bedposts, the pin further comprising restraining means.

* * * * *